United States Patent [19]

Miyamoto et al.

[11] 4,005,570

[45] Feb. 1, 1977

[54] LEAF-TYPE DIGITAL CLOCK

[75] Inventors: Kazuo Miyamoto, Showa; Hideo Koide, Urawa; Isao Suzuki, Noda, all of Japan

[73] Assignee: Rhythm Watch Company, Limited, Japan

[22] Filed: July 8, 1975

[21] Appl. No.: 593,971

[30] Foreign Application Priority Data

July 9, 1974 Japan ..... 49-77827

[52] U.S. Cl. ..... 58/16 D; 58/125 C

[51] Int. Cl.[2] ..... G04C 21/16; G04B 19/02

[58] Field of Search ..... 58/2, 16 D, 19, 21.1, 58/38, 125 C, 126 E, 127, 128

[56] References Cited

UNITED STATES PATENTS

| | | | |
|---|---|---|---|
| 2,645,896 | 7/1953 | Uhlig et al. | 58/125 C |
| 3,495,396 | 2/1970 | Funaki | 58/125 C |
| 3,685,280 | 8/1972 | Fehrenbacker | 58/38 |
| 3,875,740 | 4/1975 | Boyles | 58/125 C |

*Primary Examiner*—E. S. Jackmon

*Attorney, Agent, or Firm*—McGlew and Tuttle

[57] ABSTRACT

A leaf-type clock driven by a intermittent and segmental rotation by using so called Geneva-gear mechanism to cause turning-over of the time- and minute-indicating leaves is disclosed. This leaf-type clock has the advantages that number of the leaves may be reduced, and that the time accuracy is improved, and further that small-sized clock can be designed.

4 Claims, 9 Drawing Figures

16
16d
15
PM
AM
17
13
13d
8b
9
8a
8
6b
5
6
14
10
13d'
8d
8a
12
6a
7d
12d
7
12c
18
12a
7c
7a 20
21
19

LEAF-TYPE DIGITAL CLOCK

FIELD AND BACKGROUND OF THE INVENTION

The present invention relates to a so-called leaf-type digital clock (e.g. in U.S. Pat. No. 3,220,174) in which a plurality of tilting leaf-plates carrying figures and the like are hinged on the peripheries of horizontally oriented frames and shown in individually separated windows on the front surface of the clock.

In the leaf-type clock, there are advantages that the figures and letters to be indicated can be made much larger in comparison with those of the other kinds of digital-type clocks, in which hours, minutes and the like are marked on the cylindrical surface of drums, and further that even continuous sixty figures of minutes or thirty-one figures of dates can be indicated with only one rotary frame.

On the other hand, in such leaf-type clock, a great many sheets of leaves are needed for hour- and minute-indications in total, that is, 108 sheets of leaves at least. Then, when the minute indicating leaf is so constructed as it is divided into two kinds of parts, that is, ten-minute indicating leaf and one-minute indicating leaf while providing an AM-PM indicating mean thereto, it is estimated that only 34 sheets of leaves in total will serve for hour- and minute-indications. However, when such a division of minute-indicating leaf as above is applied to the conventional leaf-type clock which has been driven by gear train with uniform rotation, there will be caused a fatal disadvantage that it takes many minutes, after a leaf has been turned over, to make the next leaf vertical to observer's eye, for example, it takes 60 seconds for a one-minute indicating leaf, 10 minutes for a 10-minute indicating leaf and 60 minutes for an hour indicating leaf.

SUMMARY OF THE INVENTION

The present invention is directed to such a leaf-type clock as it is driven by a intermittent and segmental rotation by using so-called Geneva-gear mechanism instead of the uniform rotation of the driving gear train in the conventional leaf-type clock so as to cause turning-over of the indicating leaves.

According to the invention, by reason that it is possible to make the rotary angle of a intermittent and segmental rotation caused by the engagement of the relevant Geneva-gears large, and the time required for such a rotation short, such dividing of the minute indicating leaf into 10-minute indicating and 1-minute indicating leaves may be accomplished, resulting in reduction of the number of leaves to 34 sheets. In the leaf-type clock of the invention, the time in which the succeeding leaf, after a leaf has been turned over, become vertical to observer's eyes, is markedly reduced in comparison with those in the conventional leaf-type clocks (e.g. in the embodiment of the invention hereinafter it is 6 seconds for every kind of leaves). Such reduction of the number of leaves in the leaf-type clocks makes necessarily possible to make the rotary frames carrying the leaves small and further to make the clock itself small-sized.

Furthermore, according to the leaf-type clock of the invention, the time accuracy of the alarm mechanism is improved significantly. In the conventional leaf-type clocks, the operation of such mechanism is also caused by the uniform rotary motion of the driving gear train, so that minor deviations of the size and framework of the relevant parts affected the time accuracy of this mechanism directly. In contrast, in the present invention, since it can make the rotary angle of a intermittent and segmental rotation, as mentioned previously, large and make the time of such a rotation short, the error of the time of the alarm mechanism in the conventional leaf-type clocks as above-mentioned may be almost eliminated.

An object of the invention, accordingly, is to provide a leaf-type clock with reduced number of the indicating leaves.

Another object of the invention is to provide a small sized leaf-type clock in comparison with the customary ones.

Further object of the invention is to provide a leaf-type clock having alarm mechanism the time accuracy of which is markedly improved.

BRIEF DESCRIPTION OF THE DRAWINGS

Still further objects of the invention will be understood from the detailed explanation of the invention in reference to the accompanying drawings in which.

DESCRIPTION OF THE PREFERRED EMBODIMENTS

Figure 1:
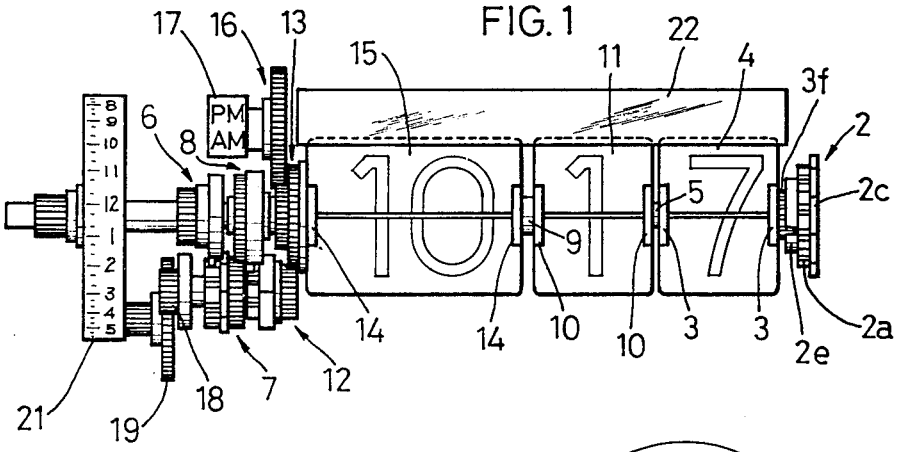
FIG. 1 is a fragmental front view of an embodiment of the invention.
Figure 2:
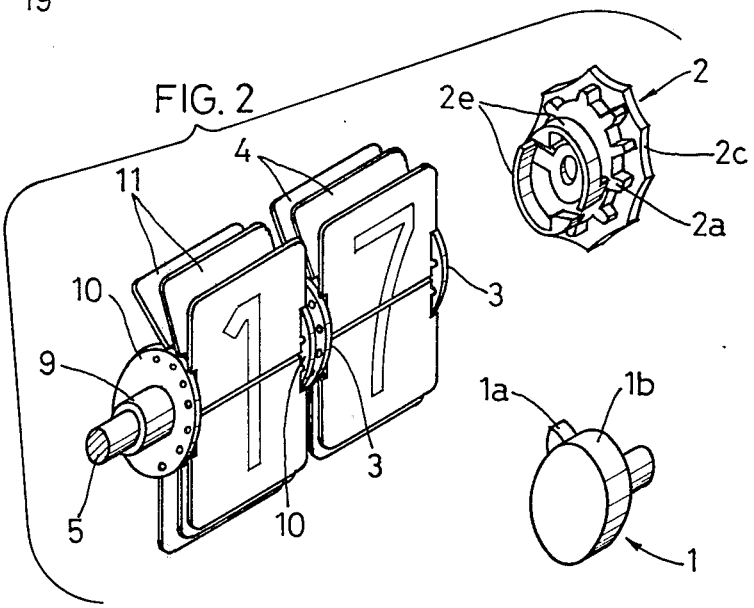
FIG. 2 is a disassembled oblique view of the one-minute wheel composition of the same embodiment.
Figure 5:
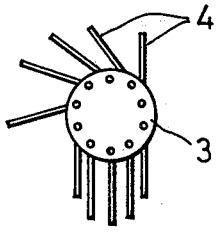
FIG. 5 is a left side view of the one-minute unit frame of the embodiment.
Figure 3:
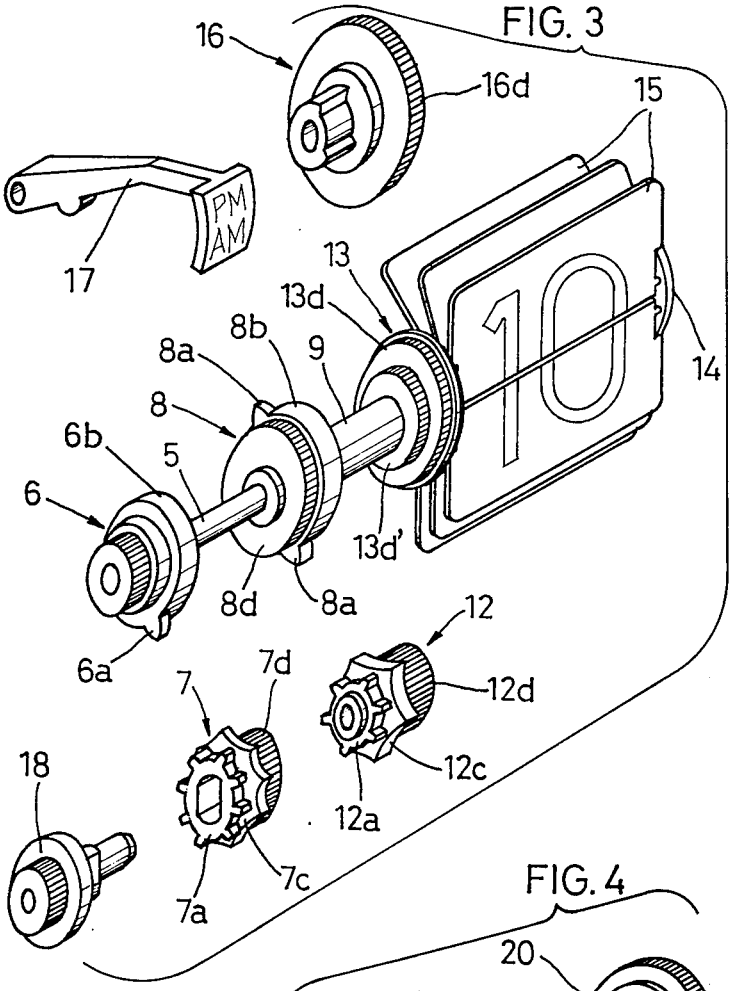
FIG. 3 is a disassembled oblique view of the ten-minute wheel composition and hour wheel composition of the same embodiment.
Figure 8:
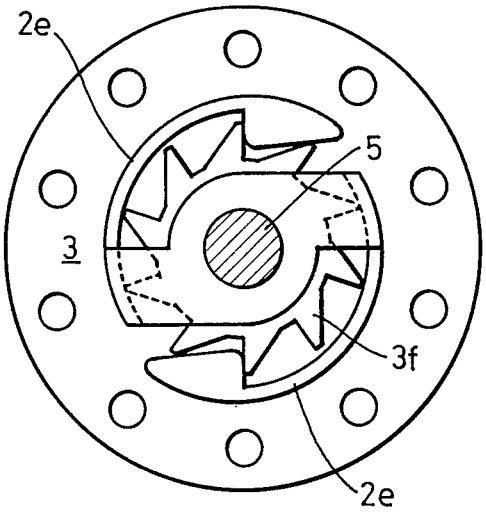
FIGS. 8 and 9 are enlarged sections illustrating the ratchet mechanism between the one-minute wheel and one-minute unit frame, but not showing the indicating leaves.
Figure 9:
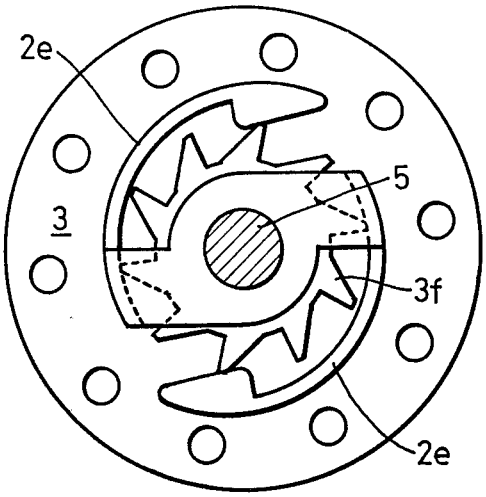

Referring now in particular to FIGS. 1, 2 and 3, the uniform rotary motion of a synchronous motor (not shown) is reduced and conveyed to the 2nd wheel (time) 1 so as to rotate the same uniformly, once per minute. The 2nd wheel 1 has the Geneva-gear part 1*a* (having one tooth) and the disc part 1*b* both of which are adjacent to each other. The 1-minute wheel 2 is mounted loosely on the shaft 5, and has the Geneva-gear part 2*a* (having 10 teeth) which engages intermittently with said Geneva-gear part 1*a* of the 2nd wheel 1 and has the adjacent star wheel part 2*c* which contacts with the circumference of said disc part 1*b* of the 2nd wheel 1 so as to check free rotation of the 1-minute wheel 2, thereby the 1-minute wheel 2 rotates by 36°, once per minute and a full rotation of it is completed in 10 minutes. One-minute unit frames 3 and 3 of one body are connected to the 1-minute wheel 2 through a ratchet mechanism and mounted rigidly on the shaft 5, and on the peripheries of this frames 3, 3 are loosely hinged ten sheets of 1-minute indicating leaves 4, 4, ..... carrying figures "0", "1", . . . "9", respectively (cf. FIG. 5). Said frames 3, 3 segmentally rotate, therefore, together with the wheel 2, and the leaves 4, 4 . . . are turned over one by one at intervals of one minute. Said ratchet mechanism is so composed as the points of a pair of jumper springs 2*e*, 2*e* which are secured to the left side of the wheel 2 are engaged with two corresponding teeth of the ratchet gear 3*f* which is secured to the right side of the frame 3 (cf. FIG. 8), so as to be able to correct the indicating time of the clock manually. That is, in FIG. 8, when the shaft 5 secured to the frames 3, 3 is caused to rotate counterclockwise by a hand setter (not shown), the points of said jumper springs 2*e*, 2*e* are released from the relevant teeth of the ratchet gear 3*f* and engage with subsequent corresponding teeth of the wheel 3*f*, resulting in manual turning-over of the leaves 4 on the frames 3, 3, while the wheel 2 together with the jumper springs 2*e*, 2*e* is being driven by the motor.

Figure 6:
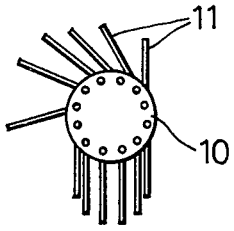
FIG. 6 is a left side view of the ten-minute unit frame of the embodiment.

To said shaft 5 is secured a 1-minute median wheel 6 a full rotation of which is completed in ten minutes together with the wheel 2 and which has the Geneva-gear part 6*a* (one tooth) and the disc part 6*b*. Further, a 10-minute median wheel 7 is mounted on an appropriate shaft and consists of the Geneva-gear part 7*a* (eight teeth) which engages intermittently with the Geneva-gear 6*a* of said wheel 6, the star wheel part 7*c* which contacts with the circumference of the disc part 6*b* of said wheel 6 so as to check the free rotation of this wheel 7, and the gear part 7*d*, thereby this wheel 7 rotates by 45°, once per 10 minutes and a full rotation of it is completed in 80 minutes. A 10 minute wheel 8 is secured to the shaft 9, in which the shaft 5 is telescoped, and consists of the Geneva-gear part 8*a* (two teeth), the disc part 8*b*, and the gear part 8*d* meshing with the gear part 7*b* of said wheel 7 in the ratio of tooth number 3 : 2, thereby this wheel 8 rotates by 30°, once per ten minutes and a full rotation of it is completed in 120 minutes. To the shaft 9 are secured ten-minute unit frames 10, 10, and on the peripheries on the frames 10, 10 are loosely hinged twelve sheets of ten-minute indicating leaves 11, 11, . . . carrying figures "0", "1". . . . "6", "0", "1", . . . "6", respectively, whereby such leaves 11, 11, . . . are turned over one by one with the rotation of the frames 10, 10 (cf. FIG. 6), at intervals of 10 minutes.

Figure 7:
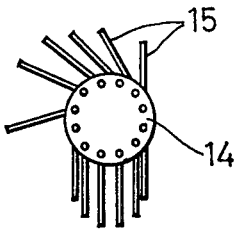
FIG. 7 is a left side view of the hour unit frame of the embodiment.

On the other hand, an hour median wheel 12 is mounted on an appropriate shaft and consists of the Geneva-gear part 12*a* (six teeth) which engages intermittently with the Geneva-gear part 8*a* (two teeth) of said wheel 8, the star wheel part 12*c* which contacts with the disc part 8*b* of said wheel 8 so as to check the free rotation of this wheel 12, and the gear part 12*d*, thereby this wheel 12 rotates by 60°, once per an hour and a full rotation of it is completed in 6 hours. Further, an hour wheel 13 is mounted loosely on the shaft 9 and has the gear part 13*d* which meshes with the gear part 12*d* of said wheel 12 in the ratio of tooth number 2 : 1, thereby this wheel 13 rotates by 30°, once per an hour and a full rotation of it is completed in twelve hours. To said wheel 13 are secured hour unit frames 14, 14, and on the peripheries of this frames 14, 14 are hinged 12 sheets of hour indicating leaves 15, 15, . . . carrying figures "1", "2", . . . "12", respectively, whereby such leaves 15, 15, . . . are turned over in order with the rotation of the frames 14, 14 (cf. FIG. 7), at intervals of one hour.

The upper end of each of the one-minute indicating, ten-minute indicating and hour indicating leaves, 4, 4, . . . , 11, 11, . . . , 15, 15, . . . is slightly caught by the lower edge of the beam 22 installed on the upper part of the frontage of the clock, and thereby the spontaneous falling of the leaf due to the gravity is prevented during the time from the instant of its having come to vertical position up to the instant of its beginning to fall by the next intermittent and segmental rotation.

On the hour wheel 13, there is also a small gear part 13*d*', which meshes with the gear part 16*d* of a AM-PM indicating cam 16 in the ratio of tooth number 2 : 1, and thereby a full rotation of the cam 16 is completed in 24 hours, resulting in indication of letters "AM" (ante meridiem) or "PM" (past meridiem) of the AM-PM indicating lever 17 by intermittent contact of the cam 16 with the lever 17.

Figure 4:
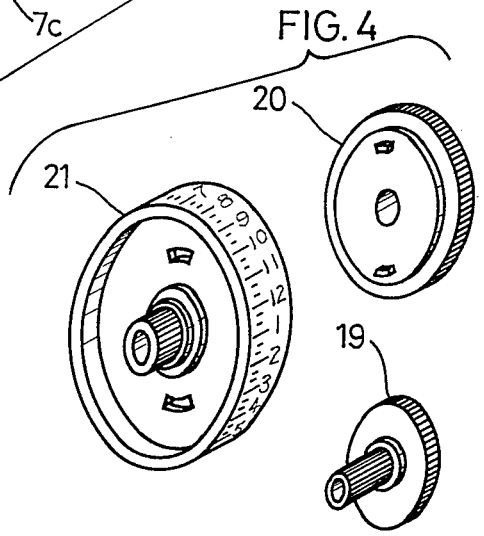
FIG. 4 is a disassembled oblique view of the alarm mechanism of the same embodiment.

Furthermore, to the 10-minute median wheel 7 is secured an idle gear 18, a full rotation of which is completed in 80 minutes together with said wheel 7, and which is so constructed as it is connected with the alarm gear 20 through the alarm median gear 19, so as to complete a full rotation of the gear 2 in 24 hours resulting in joining of the gear 20 with the alarm dial 21 at the predetermined time and in operation of the alarm bell or the like (cf. FIG. 4).

In the aforementioned embodiment of the invention, were arranged 10 sheets of the 1-minute indicating leaves 4, 4, . . . , however, it may generally by any multiple of 10, that is, 10, 20, 30, . . . 10m. Such leaves 4, 4, . . . may be so arranged as the successive numerals of them are repeated as "0", . . . "9", "0", . . . "9", . . . , while the 1-minute wheel 2 being so designed as it segmentally rotates once per minute constantly and a full rotation of it is completed in 10, 20, . . . 10*m* minutes, respectively ("*m*"is a positive integer), Likewise, in the embodiment, 12 sheets of the 10-minute indicating leaves 11, 11, . . . were arranged, which number might however be any multiple of 6, that is, 6, 12, . . . 6*n*. The leaves 11, 11, . . . may be so arranged as their successive numerals are repeated as "0", . . . "5", "0", . . . "5", . . . , while the 10-minute wheel 8 being so designed as it segmentally rotates once per ten minutes constantly and a full rotation of it is completed in 1, 2, . . . *n* hour(s), respectively ("*n*"is a positive integer).

Furthermore, the number of hour indicating leaves 15, 15, . . . may be any multiple of 12, that is, 12, 24, 36, . . . 12*p*, and the leaves 15, 15, . . . may be so arranged as their successive numerals are repeated as "1", . . . "12", "1", . . . "12", . . ., while the hour wheel 13 being so designed as it segmentally rotates once per hour constantly and a full rotation of it is completed in 12, 24, . . . 12*p* hours, respectively ("*p*" is a positive integer).

On the other hand, said one-minute indicating leaves 4, 4, . . . may be, for the number thereof being 20, 30, . . . 10*m* sheets, so arranged as the same numerals of them are repeated as "0", "0", . . ., "1", "1", . . ., while the 1-minute wheel 2 being so designed as it segmentally rotates once per ½, ⅓, . . . 1/*m* minute, respectively, and a full rotation of it is completed constantly in 10 minutes. Likewise, the 10-minute indicating leaves 11, 11, . . . may be so arranged as the same numerals of them are repeated as "0", "0". . ., "1", "1", . . ., while the 10-minute wheel 8 being so designed as it segmentally rotates once per 10/1, 10/2, . . . 10/*n* minutes, respectively, and a full rotation of it is completed constantly in an hour. Moreover, the hour indicating leaves 15, 15 . . . may be so arranged as the same numerals of them are repeated as "1", "1", . . ., "2", "2", . . . while the hour wheels 13 is so designed as it segmentally rotates once per ½, ⅓, . . . 1/*p* hour, respectively, and a full rotation of it is completed constantly in 12 hours.

In the present invention, it is preferable to make the sheet numbers of the three kinds of indicating leaves, i.e., the 1-minute indicating, 10-minute indicating and hour indicating leaves as approximate to each other as possible. For example, it is most suitable to adopt 30 sheets of the 1-minute indicating leaves, 24 sheets of the 10-minute indicating leaves and 24 sheets of the hour indicating leaves. In order to indicate the AM-PM, it may also adopt such a way as the letters "AM" or "PM" are directly illustrated in the upper corner of the corresponding hour indicating leaves 15, 15, . . . , respectively. The number of the jumper springs 2*e*, 2*e* in the above embodiment may be increased if necessary.

Further, in the present invention, in order to check the free rotation of the subordinate wheels (i.e., the one-minute wheel 2, 10-minute median wheel 7 and hour median wheel 12) in the Geneva-engagements, it may be applied thereto other known means, which have been generally employed in the Geneva-engagement, instead of such contacts of the star wheels part 2*c*, 7*c* and 12*c* with the respective disc parts of the preceding wheels (i.e., the 2nd wheel 1, 1-minute median wheel 6 and 10-minute wheel 8), as explained in the above embodiment.

What we claim is:

1. In a leaf-type digital clock in which hour indicating, 10-minute indicating and 1-minute indicating leaves are hinged on the horizontally oriented frames and shown in the front windows of the clock, providing that m, n and p are all positive integers, a combination of the following A-14 J:

A. the 2nd wheel (time) (1) connected with a synchronous motor and having the Geneva-gear part (1*a*), B. a 1-minute wheel (2) mounted loosely on the shaft (5) and having the Geneva-gear part 2*a* which engages intermittently with said Geneva-gear part (1*a*), C. a 1-minute median wheel (6) secured to the shaft (5) and having the Geneva-gear part (6*a*), D. a 10-minute median wheel (7) consisting of the Geneva-gear part (7*a*) which engages intermittently with said Geneva-gear part (6*a*) and the gear part (7*d*), E. a 10-minute wheel (8) secured to the shaft (9) in which the shaft (5) is telescoped, and consisting of the Geneva-gear part (8*a* ) and the gear part (8*d*) which meshes with said gear part (7*d*), F. a hour median wheel (12) consisting of the Geneva-gear part (12*a*) which engages intermittently with said Geneva-gear part (8*a*), and the gear part (12*d*), G. an hour wheel (13) mounted loosely on the shaft (9) and having the gear part (13*d*) which meshes with said gear part (12*d*), H. 1-minute unit frames (3, 3) of one body secured to said shaft (5) but connected with said one-minute wheel 2 through ratchet mechanism, and carrying (10*m*) sheets of one-minute indicating leaves (4, 4), . . . on their peripheries, said ratchet mechanism being so composed as the points of jumper springs (2*e*, 2*e*), . . . which are anchored on the wheel (2) are engaged with corresponding teeth of the ratchet gear (3*f*) which is anchored on the frame (3), I. 10-minute unit frames (10, 10) of one body secured to said shaft (9) and carrying 6*n* sheets of 10-minute indicating leaves (11, 11), . . . on their peripheries, J. hour unit frames (14, 14) of one body secured to said hour wheel (13) and carrying 12*p* sheets of hour indicating leaves (15, 15) . . . on their peripheries.

2. A leaf-type digital clock in claim 1, wherein a star wheel part (2*c*) secured to the 1-minute wheel (2) contacts with the circumference of a disc part (1*b*) formed on the 2nd wheel (1); a star wheel part (7*c*) secured to the 10-minute median wheel (7) contacts with the circumference of a disc part (6*b*) formed on the 1-minute median wheel (6); and a star wheel part (12*c*) secured to the hour median wheel 12 contacts with the circumference of a disc part (8*b*) formed on the 10-minute wheel 8.

3. A leaf-type digital clock in claim 1, wherein a small gear part (13*d'*) anchored on the hour wheel (13) meshes with the gear part (16*d*) of an AM-PM indicating cam (16), which cam (16) contacts intermittently with the AM-PM indicating lever (17).

4. A leaf-type digital clock in claim 1, wherein an idle gear (18) secured to the 10-minute median wheel (7) connects with the alarm gear (20) through the alarm median gear (19) so as to join the alarm gear (20) with the alarm dial (21) at the preditermined time resulting in operation of the alarm bell.

* * * * *